US010978831B2

(12) United States Patent
Zhao et al.

(10) Patent No.: US 10,978,831 B2
(45) Date of Patent: Apr. 13, 2021

(54) ELECTRICAL CONNECTOR HAVING A FIRST POWER CONTACT AND A SHORTER SECOND POWER CONTACT

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jun Zhao, Huaian (CN); Gang Hu, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/423,193

(22) Filed: May 28, 2019

(65) Prior Publication Data

US 2019/0372273 A1 Dec. 5, 2019

(30) Foreign Application Priority Data

May 30, 2018 (CN) ..... 201810541377.6

(51) Int. Cl.
*H01R 13/642* (2006.01)
*H01R 13/405* (2006.01)
*H01R 13/6581* (2011.01)

(52) U.S. Cl.
CPC ..... *H01R 13/642* (2013.01); *H01R 13/405* (2013.01); *H01R 13/6581* (2013.01)

(58) Field of Classification Search
CPC ..... H01R 13/639; H01R 13/6585; H01R 13/6581; H01R 24/60; H01R 13/6586; H01R 24/62; H01R 13/6461; H01R 13/405; H01R 13/642
USPC ..... 439/374
See application file for complete search history.

(56) References Cited

U.S. PATENT DOCUMENTS

| | | | | |
|---|---|---|---|---|
| 2017/0018883 | A1* | 1/2017 | Chen | H01R 24/62 |
| 2017/0229823 | A1* | 8/2017 | Tsai | H01R 24/60 |
| 2017/0365954 | A1* | 12/2017 | Chen | H01R 13/6461 |
| 2018/0151992 | A1* | 5/2018 | Zhao | H01R 13/6586 |
| 2018/0183186 | A1* | 6/2018 | Yu | H01R 13/6581 |
| 2018/0226758 | A1* | 8/2018 | Chen | H01R 12/58 |
| 2019/0131745 | A1* | 5/2019 | Zhao | H01R 13/6585 |
| 2019/0148888 | A1* | 5/2019 | Huang | H01R 13/6597 439/607.05 |
| 2019/0173235 | A1* | 6/2019 | Feng | H01R 13/639 |
| 2019/0173238 | A1* | 6/2019 | Ba | H01R 13/6597 |

FOREIGN PATENT DOCUMENTS

CN 107465014 A 12/2017

* cited by examiner

*Primary Examiner* — Jean F Duverne
(74) *Attorney, Agent, or Firm* — Wei Te Chung; Ming Chieh Chang

(57) ABSTRACT

An electrical connector includes: an insulative housing having a base and a tongue; and plural contacts arranged in an upper and lower rows and exposed respectively to an upper and lower surfaces of the tongue, wherein the upper and lower rows of contacts include a first and second power contacts in the same row, the second power contact being shorter than the first power contact so as to be prevented from making an electrical contact with an ordinary connector.

12 Claims, 15 Drawing Sheets

| A1 | A2 | A3 | A4 | A5 | A6 | A7 | A8 | A9 | A10 | A11 | A12 |
|---|---|---|---|---|---|---|---|---|---|---|---|
| VGND | | VCC2 | VCC1 | CC | D+ | D- | SBU1 | VCC1 | | | VGND |
| | | | | | | | | | | | |
| VGND | | | VCC1 | SBU2 | D- | D+ | VCONN | VCC1 | VCC2 | | VGND |
| B12 | B11 | B10 | B9 | B8 | B7 | B6 | B5 | B4 | B3 | B2 | B1 |

FIG. 13

ELECTRICAL CONNECTOR HAVING A FIRST POWER CONTACT AND A SHORTER SECOND POWER CONTACT

BACKGROUND OF THE INVENTION

1. Field of the Invention

The present invention relates to an electrical connector having a first and second power contacts in a same row, wherein the second power contact adapted to mate with a corresponding power contact of a specific complementary connector is shorter than the first power contact so as not to contact a non-power contact of an ordinary connector.

2. Description of Related Art

China Patent No. 107465014 discloses an electrical connector comprising an insulative housing having a base and a tongue, and a plurality of contacts arranged in an upper and lower rows and exposed respectively to an upper and lower surfaces of the tongue, wherein each of the upper and lower rows includes one outermost ground contact and one power contact spaced from the outermost ground contact by two contact positions. Such one power contact conducts only limited current.

SUMMARY OF THE INVENTION

An electrical connector comprises: an insulative housing having a base and a tongue; and a plurality of contacts arranged in an upper and lower rows and exposed respectively to an upper and lower surfaces of the tongue, wherein the upper and lower rows of contacts include a first and second power contacts in the same row, the second power contact being shorter than the first power contact so as to be prevented from making an electrical contact with an ordinary connector.

BRIEF DESCRIPTION OF THE DRAWING

FIG. 13 is a schematic table showing contact positions of the electrical connector;

DETAILED DESCRIPTION OF THE PREFERRED EMBODIMENT

Figure 1:
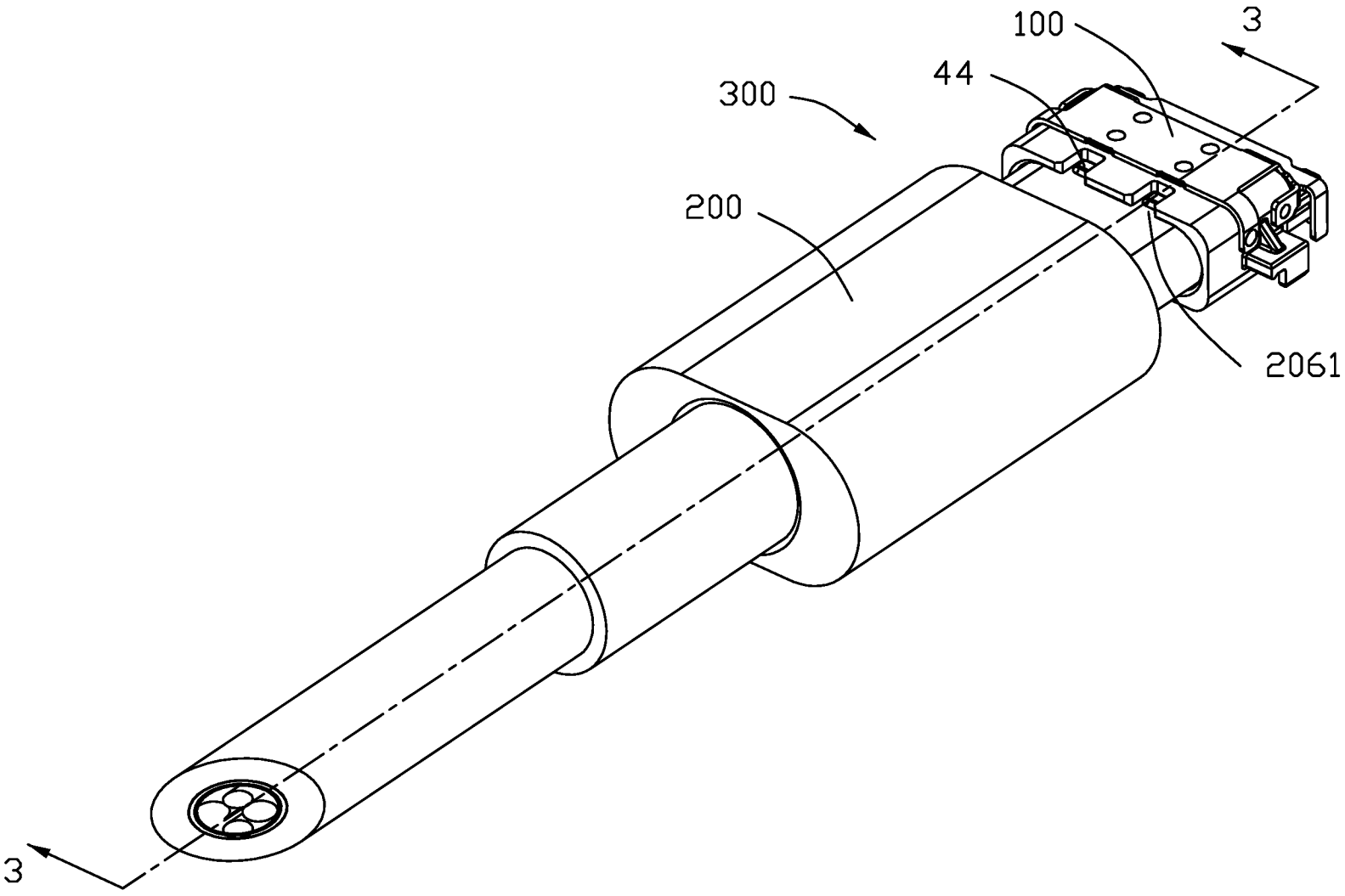
FIG. 1 is a perspective view of an electrical connector assembly in accordance with the present invention.
Figure 2:
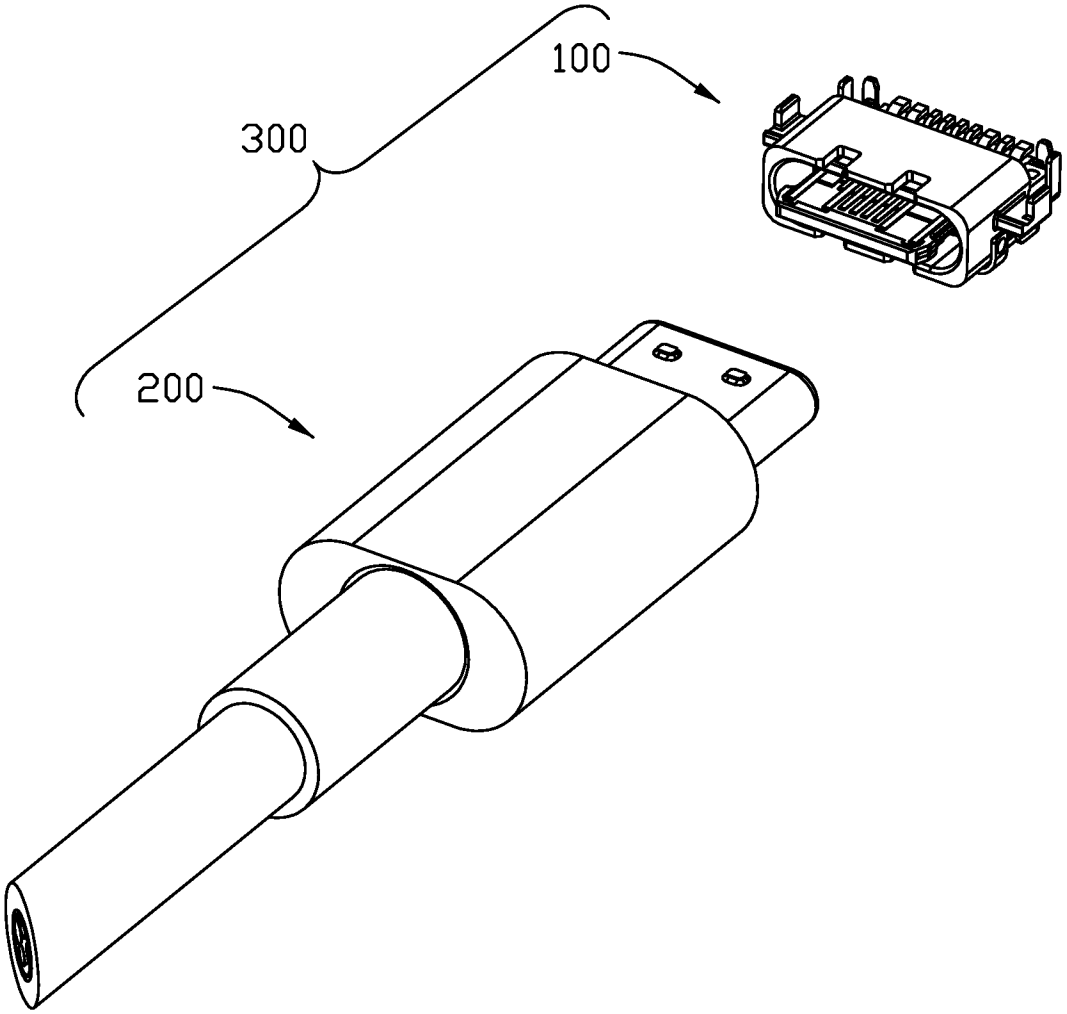
FIG. 2 is a perspective view of the electrical connector assembly in FIG. 1 before mating.
Figure 3:
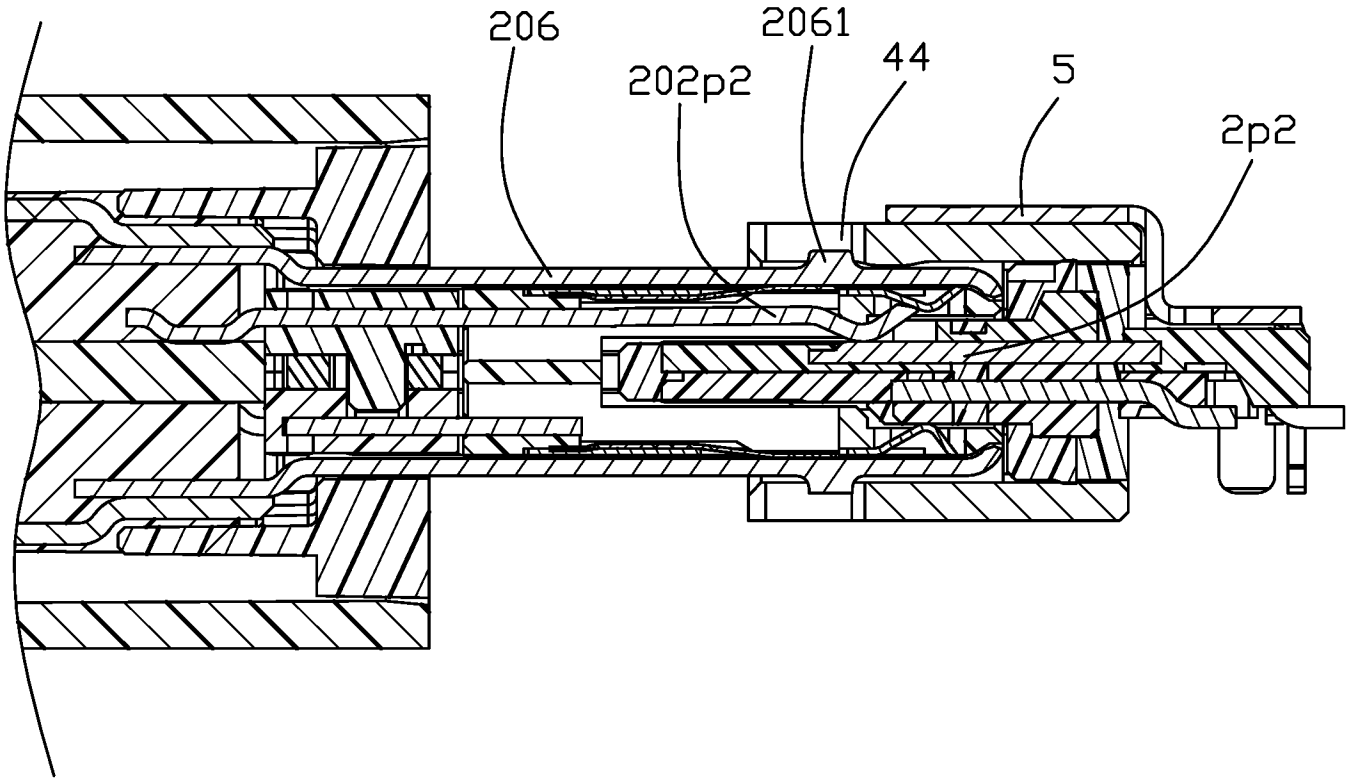
FIG. 3 is a cross-sectional view of the electrical connector assembly taken along line A-A in FIG. 1.
Figure 4:
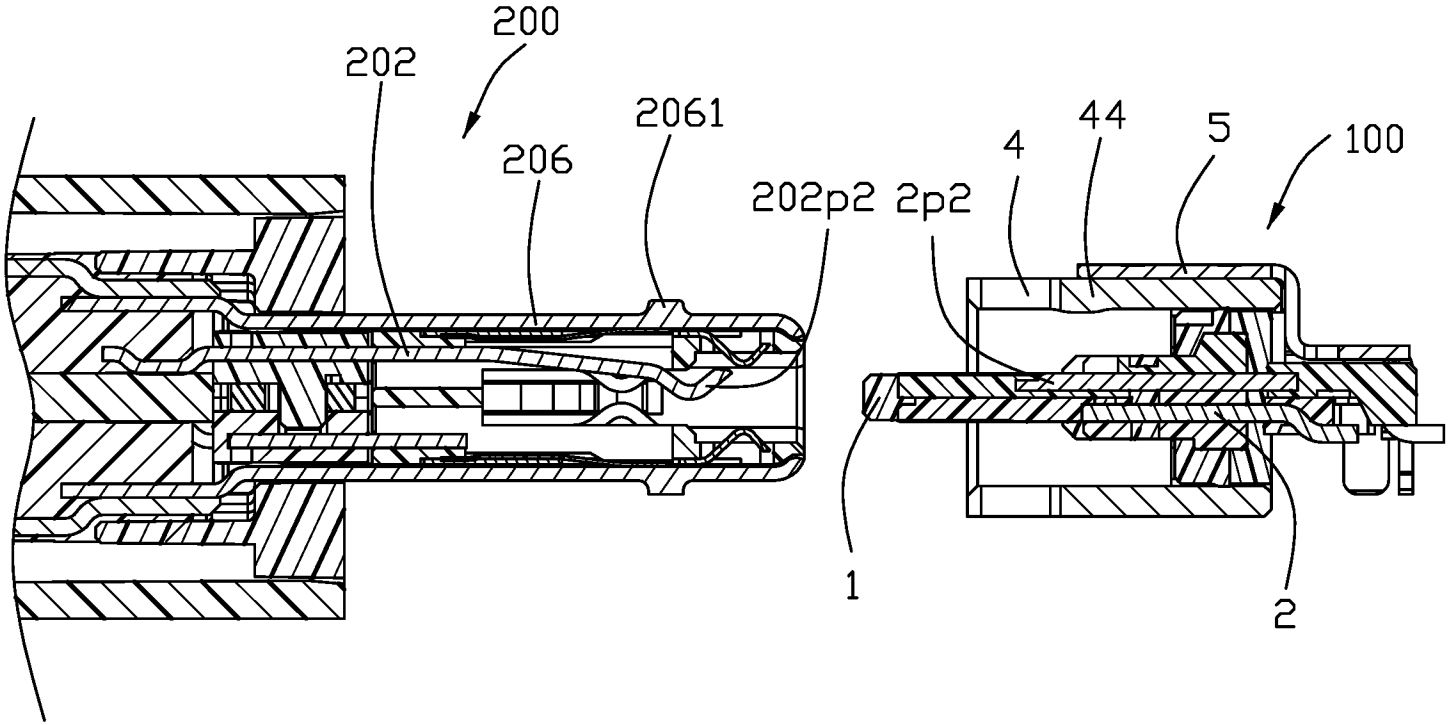
FIG. 4 is a cross-sectional view similar to FIG. 3 but taken in FIG. 2.
Figure 5:
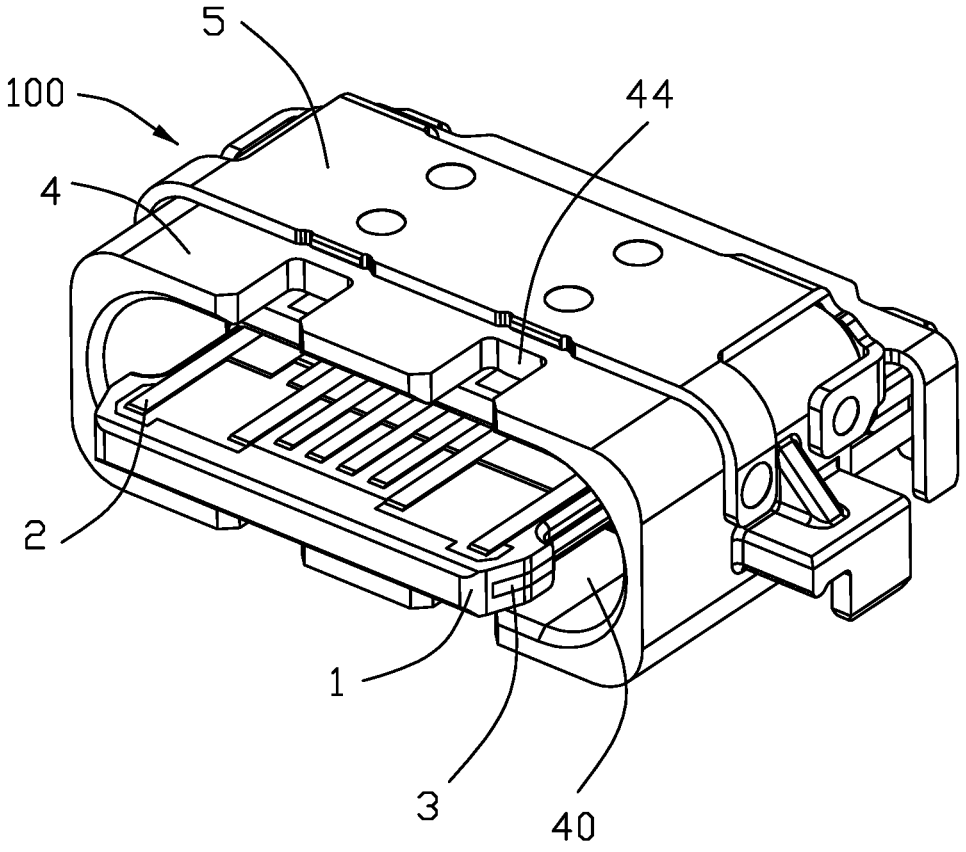
FIG. 5 is a perspective view of an electrical connector in accordance with the present invention.
Figure 6:
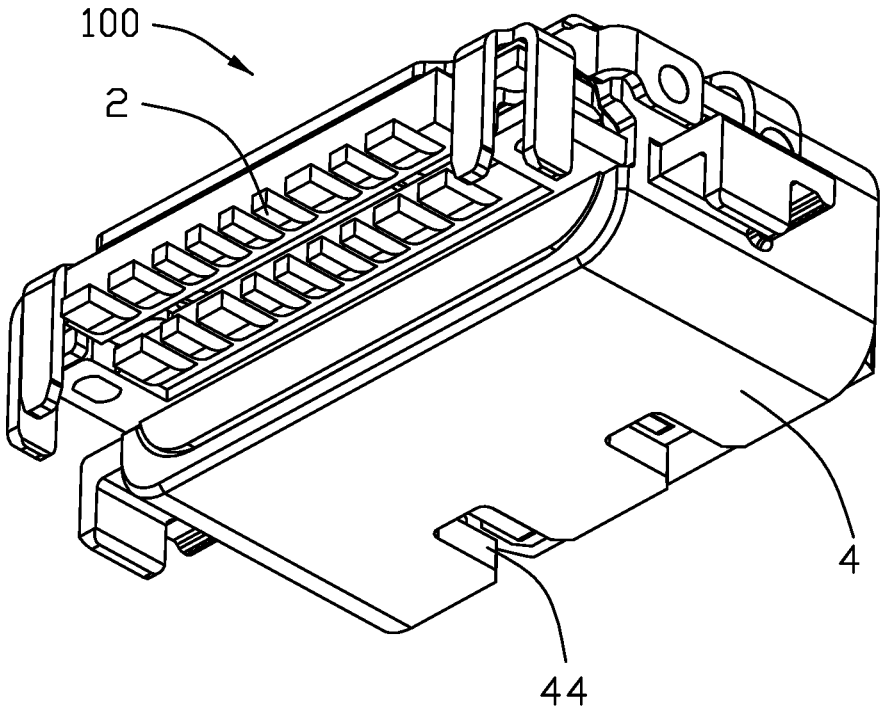
FIG. 6 is a view similar to FIG. 5 but from a different perspective.
Figure 7:
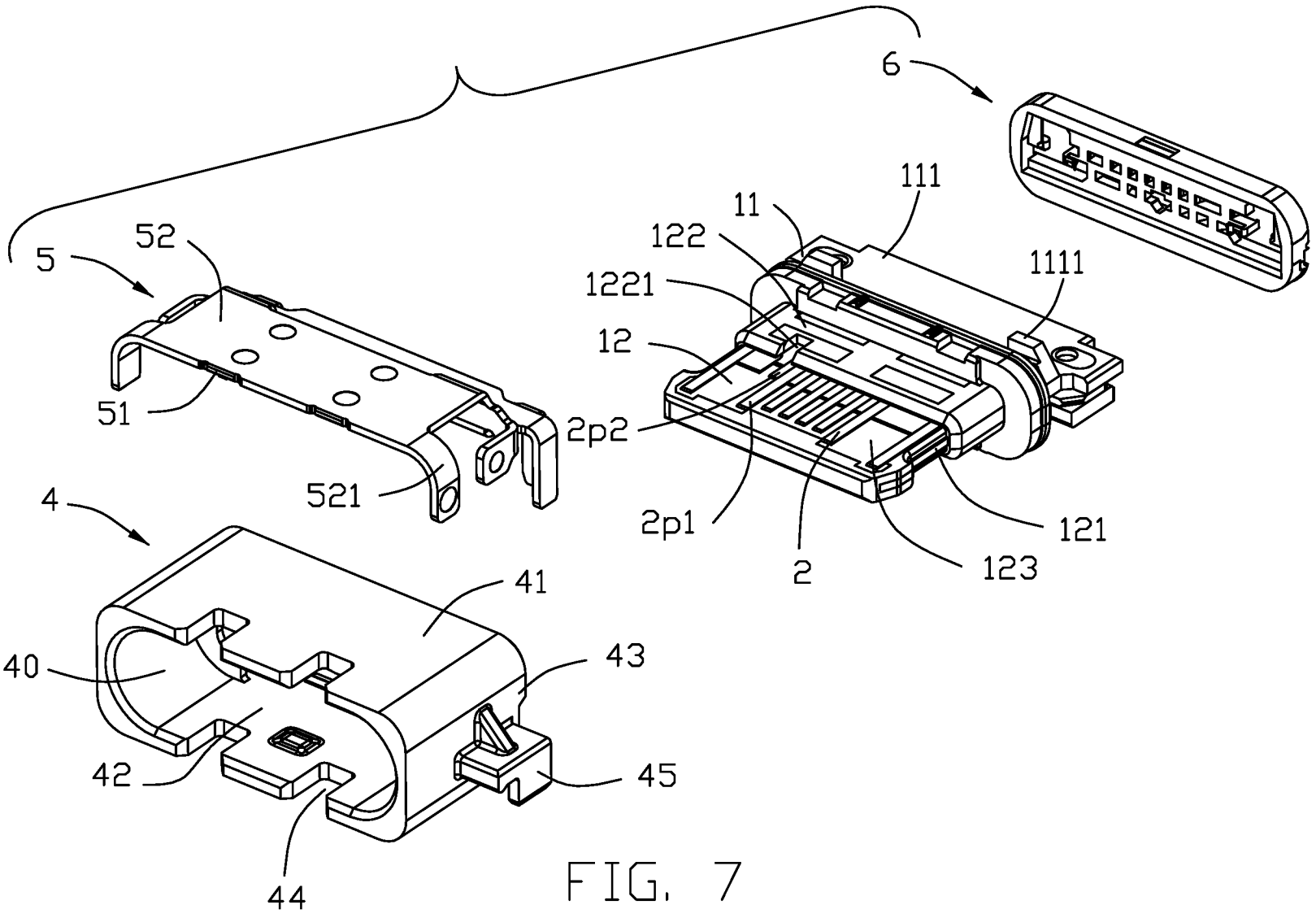
FIG. 7 is an exploded view of the electrical connector.
Figure 8:
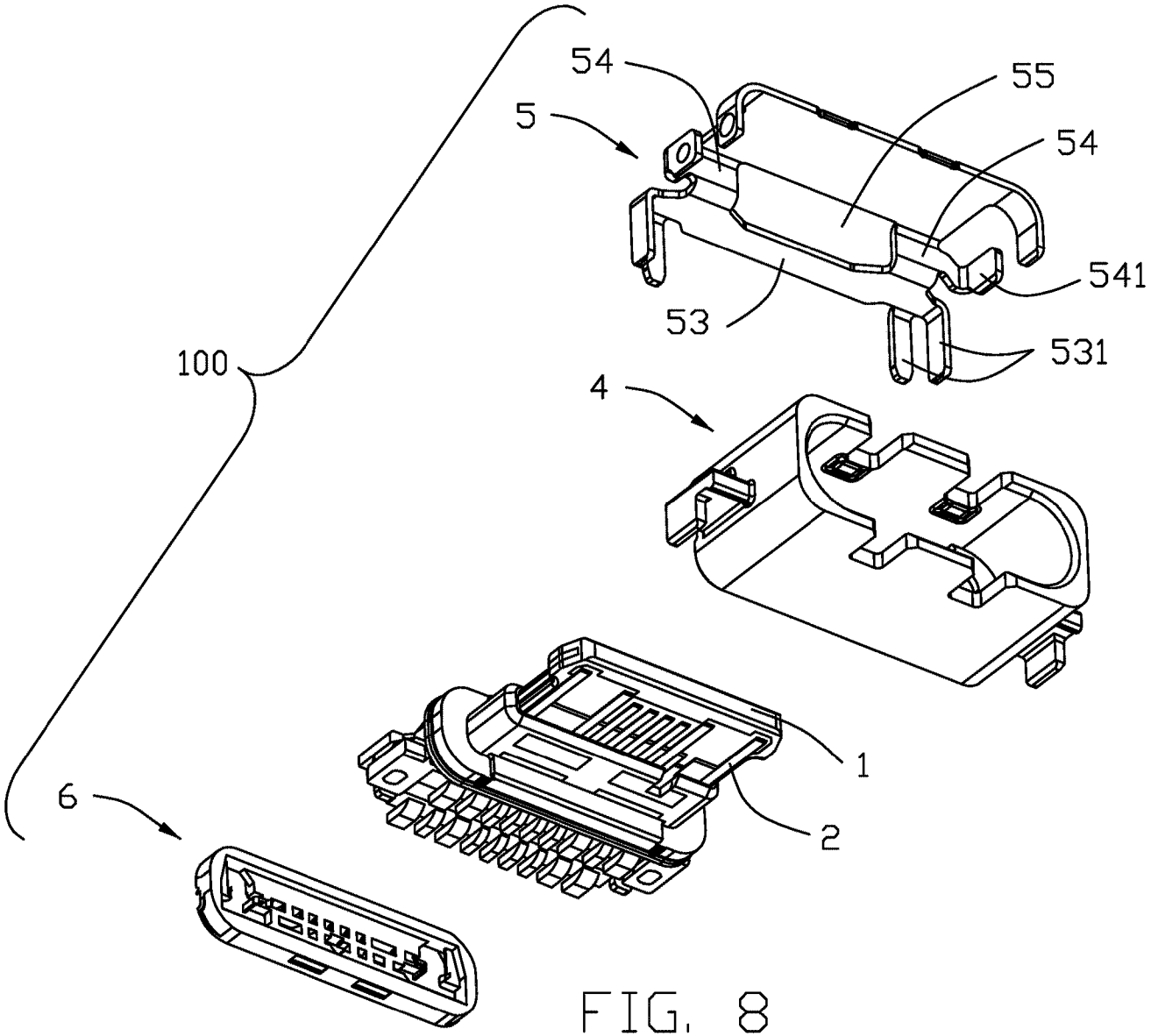
FIG. 8 is a view similar to FIG. 7 but from a different perspective.
Figure 9:
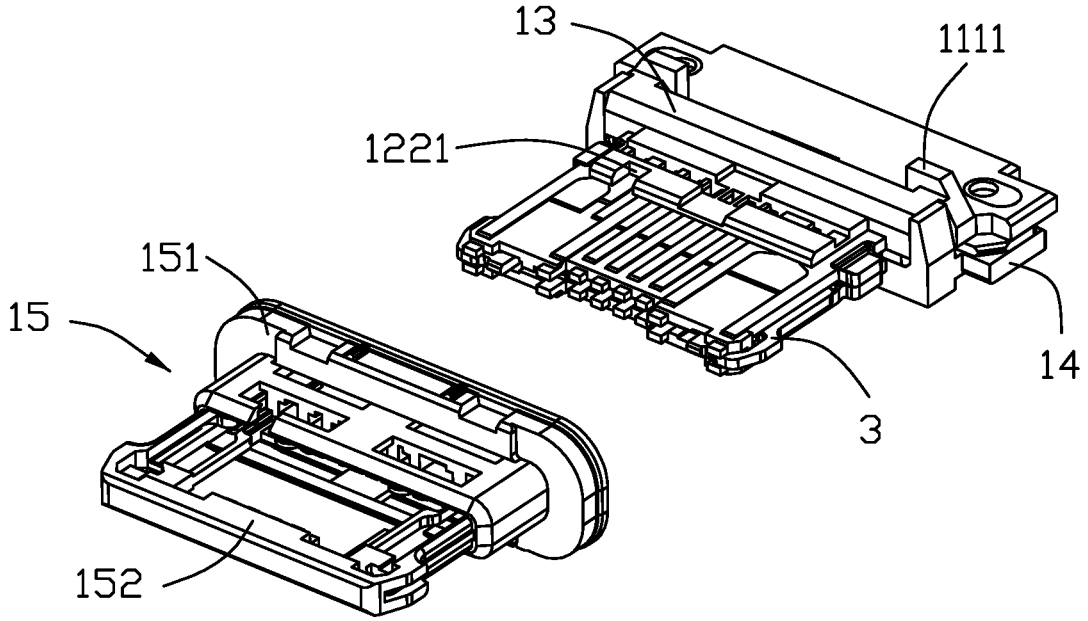
FIG. 9 is an exploded view of a contact module of the electrical connector.

Referring to FIGS. 1-15, an electrical connector assembly 300 includes an electrical connector 100 and a complementary connector 200. The electrical connector 100 comprises an insulative housing 1 and an upper and lower rows of contacts 2. The electrical connector 100 may further include a shielding plate between the upper and lower rows of contacts 2, a shielding shell 4 enclosing the insulative housing 1 and having a receiving space 40, an auxiliary shell 5 attached to the shielding shell 4, and a rear sealing member 6.

Referring to FIGS. 7-13, the insulative housing 1 has a base 11 and a front tongue 12. The base 11 has a rear extension 111. The rear extension 111 has two stops 1111. The tongue 12 has a pair of notches 121. An upper and lower surfaces of the tongue 12 have twelve (12) contact positions A1-A12 and B12-B1, respectively. The tongue 12 includes a flat portion 123 and a thickened portion 122. The thickened portion 122 has a respective groove 1221 on each of two opposite surfaces thereof. The grooves 1221 on the two surfaces are centrally-symmetrically arranged. Referring to FIGS. 9-12, the insulative housing 1 includes a first insulator 13, a second insulator 14, and a third insulator 15. The first insulator 13 has a base portion 131 and a tongue portion 132. The base portion 131 has a first rear extending portion 1311. The second insulator 14 has a base portion 141 and a tongue portion 142. The base portion 141 has a second rear extending portion 1411. The first and second rear extending portions 1311 and 1411 constitute the rear extension 111. The stops 1111 are disposed at a rear of the first rear extending portion 1311. The third insulator 15 has a base portion 151 and a tongue portion 152.

Each of the upper row of contacts 21 and the lower row of contacts 22 has a contacting portion 23, a soldering portion 25, and an intermediate securing portion 24. The contacting portions 21 are exposed respectively to an upper and lower surfaces of the tongue 12. The upper row of contacts 21 are centrally-symmetrically arranged with respect to the lower row of contacts 22 to support two orientations mating, as is well known in this art. Each row of contacts 21 or 22 includes two outermost ground contacts 2*g* at first and twelfth contact positions, two first power contacts 2*p*1 at fourth and ninth contact positions, one second power contact 2*p*2 at third contact position, and four signal contacts at contact positions between the two power contacts 2*p*1. The second power contact 2*p*2 may alternatively be provided at second contact position. In this embodiment there is a total of nine (9) contacts in each row. The second power contact 2*p*2 is shorter than the first power contact 2*p*1 so as to be prevented from making an electrical contact with an ordinary complementary connector. The position of the groove 1221 corresponds to the position of the second power contact 2*p*2. The groove 1221 further exposes the second power contact 2*p*2.

Figure 10:
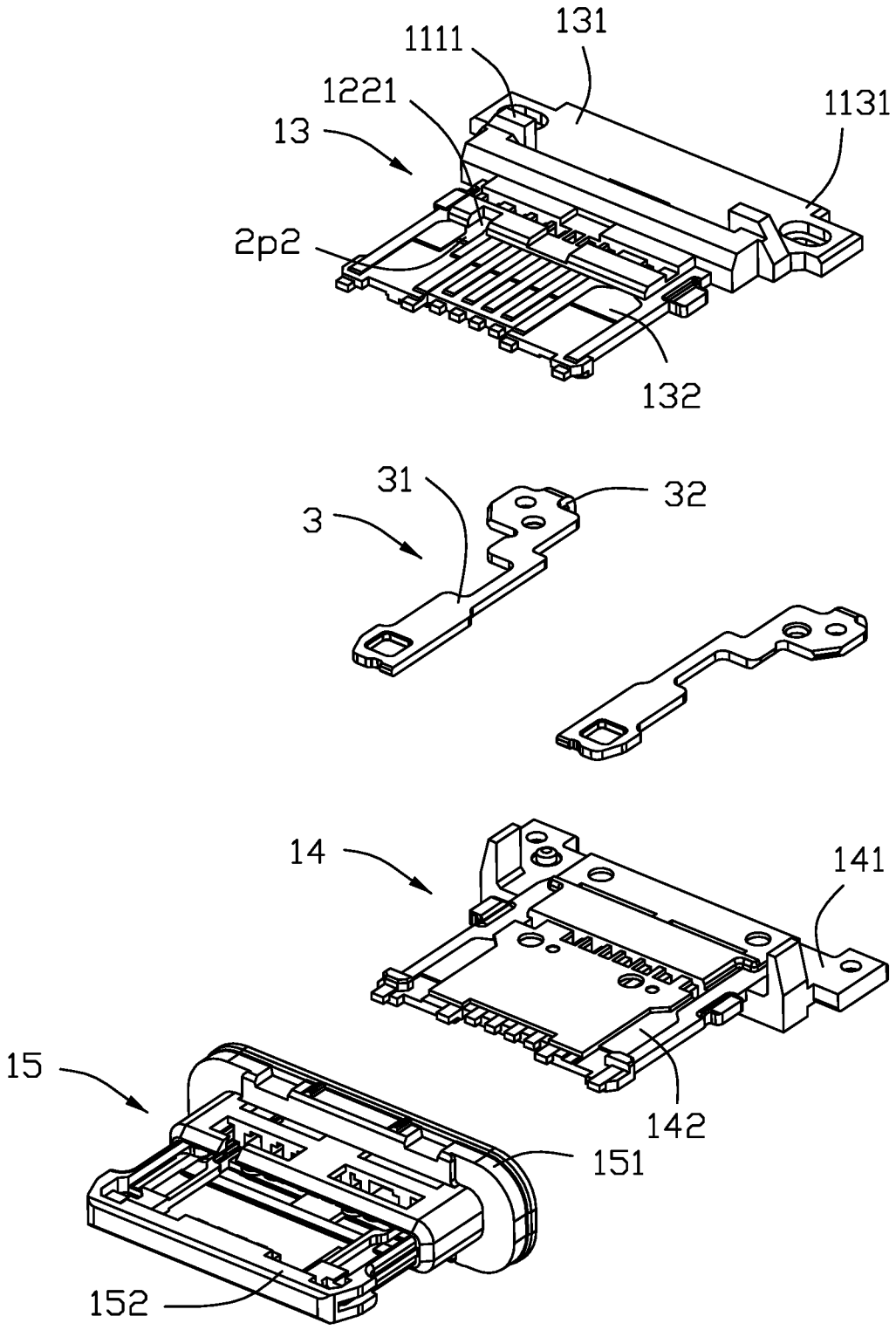
FIG. 10 is a further exploded view of the contact module.
Figure 11:
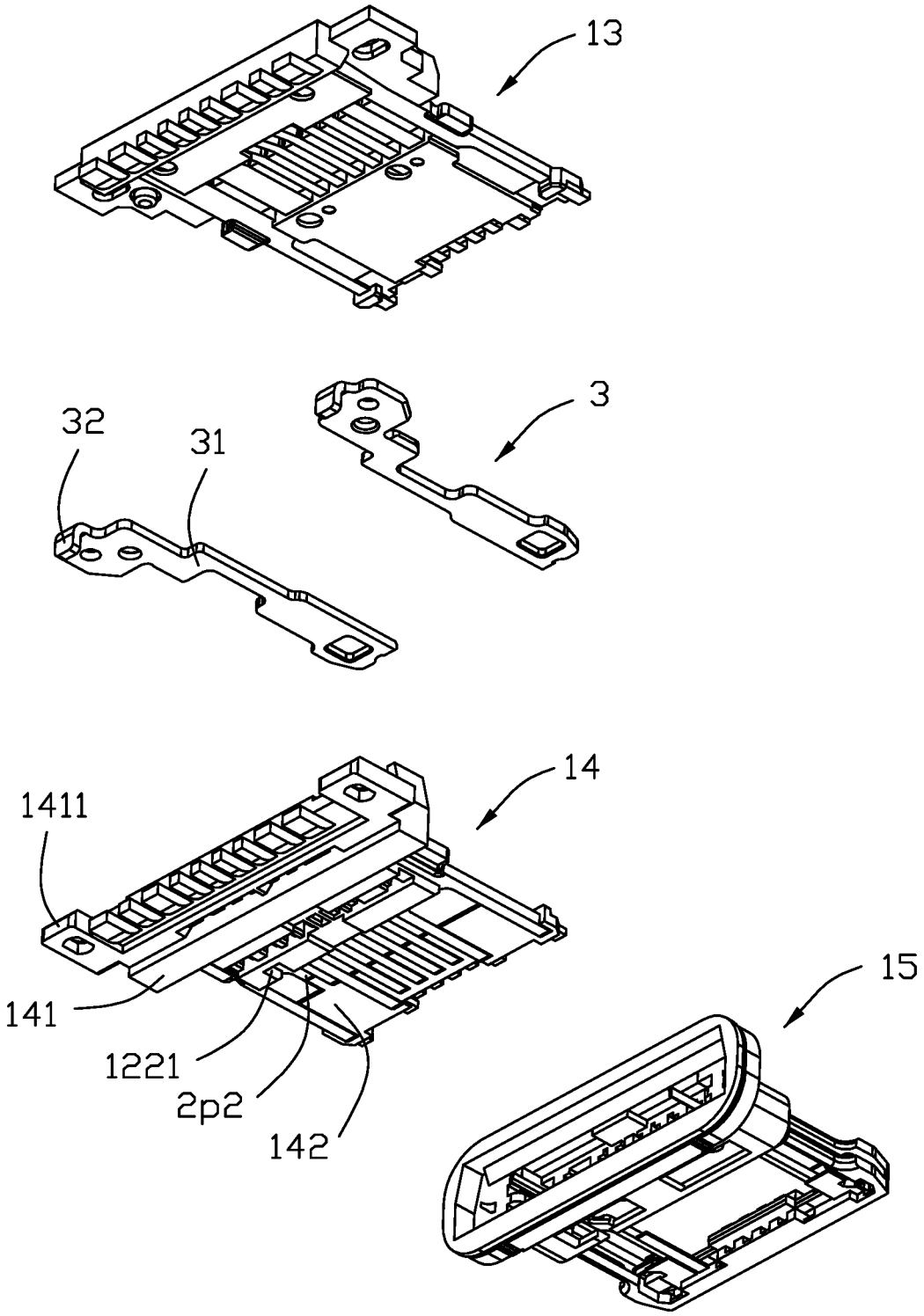
FIG. 11 is a view similar to FIG. 10 but from a different perspective.
Figure 12:
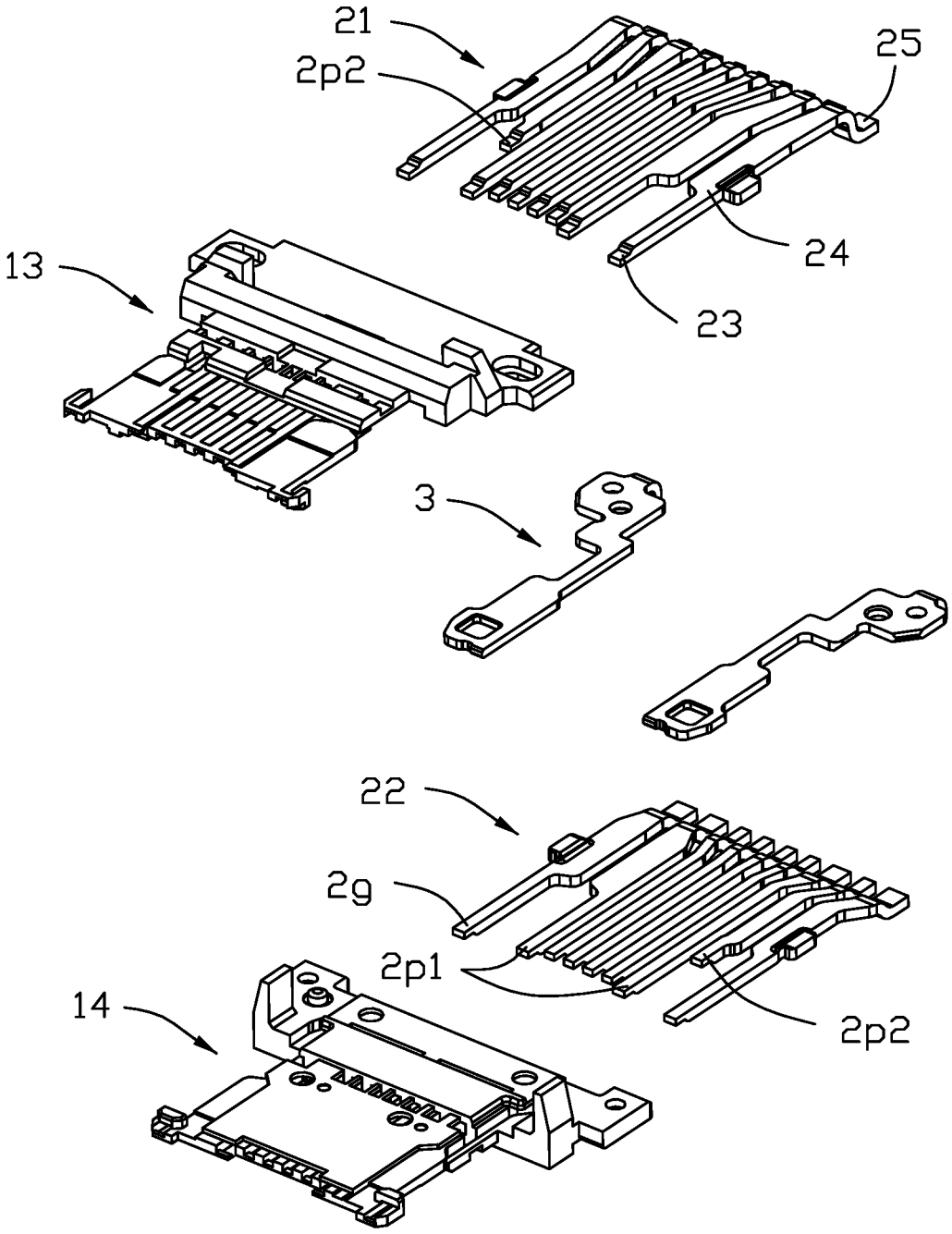
FIG. 12 is another further exploded view of the contact module.

Referring to FIGS. 10-12, the shielding plate 3 is a two-piece structure secured to the insulative housing 1. The shielding plate 3 has a main part 31 and a soldering leg 32.

Referring to FIGS. 4-8, the shielding shell 4 is formed metallurgically to have a top wall 41, a bottom wall 42, and two side walls 43. Each of the top and bottom walls 41 and 42 has a pair of slots 44 each open to a front thereof. The slots 44 of the top wall 41 correspond to contacts positions A2-A3 and A10-A11. The slots 44 of the bottom wall 42 correspond to contacts positions B2-B3 and B10-B11. The side walls 43 have a pair of soldering legs 45.

Referring to FIGS. 5-8, the auxiliary shell 5 is spot welded to the shielding shell 4. The auxiliary shell 5 has a front 51 aligned with a rear of the slot 44. The auxiliary shell 5 includes a first cover 52, a second cover 53, a pair of connecting portions 54 between the first and second covers 52 and 53, and a cross-beam 55 between the pair of connecting portions 54. The first cover 52 has a pair of fixing legs 521. The second cover 53 has a pair of fixing legs 531. Each connecting portion 54 has a fixing leg 541.

Referring to FIGS. 1-4 and 14-15, the complementary connector 200 includes an insulative housing 201 defining a receiving space 2010 and an upper and lower rows of contacts 202. The complementary connector 200 may further include a grounding plate/latch 203, a pair of grounding engaging pieces 204, a pair of covering pieces 205 attached to the pair of engaging pieces 204, and a shielding cover 206 enclosing the insulative housing 201. The insulative housing 201 and the contacts 202 constitute a contact module. Each row of contacts 202*a* or 202*b* includes two outermost ground contacts 202*g* at first and twelfth contact positions, two first power contacts 202*p*1 at fourth and ninth contact positions, one second power contact 202*p*2 at third contact position, and four signal contacts at contact positions between the two power contacts 202*p*1. The second power contact 202*p*2 is longer than the other contacts and is adapted for mating the second power contact 2*p*2 of the electrical connector 100. In this embodiment the second power contact 202*p*2 enters the groove 1221 during mating. Notably, the housing 201 forms a plurality of openings 2011 to receive the corresponding spring fingers 2041 of the grounding engaging pieces 204. Clearly, all contacts 202 are located behind those openings 2011 in the front-to-back direction except that the front end of second power contact 202*p*2 is located between the two adjacent openings 2011 in the transverse direction.

Figure 14:
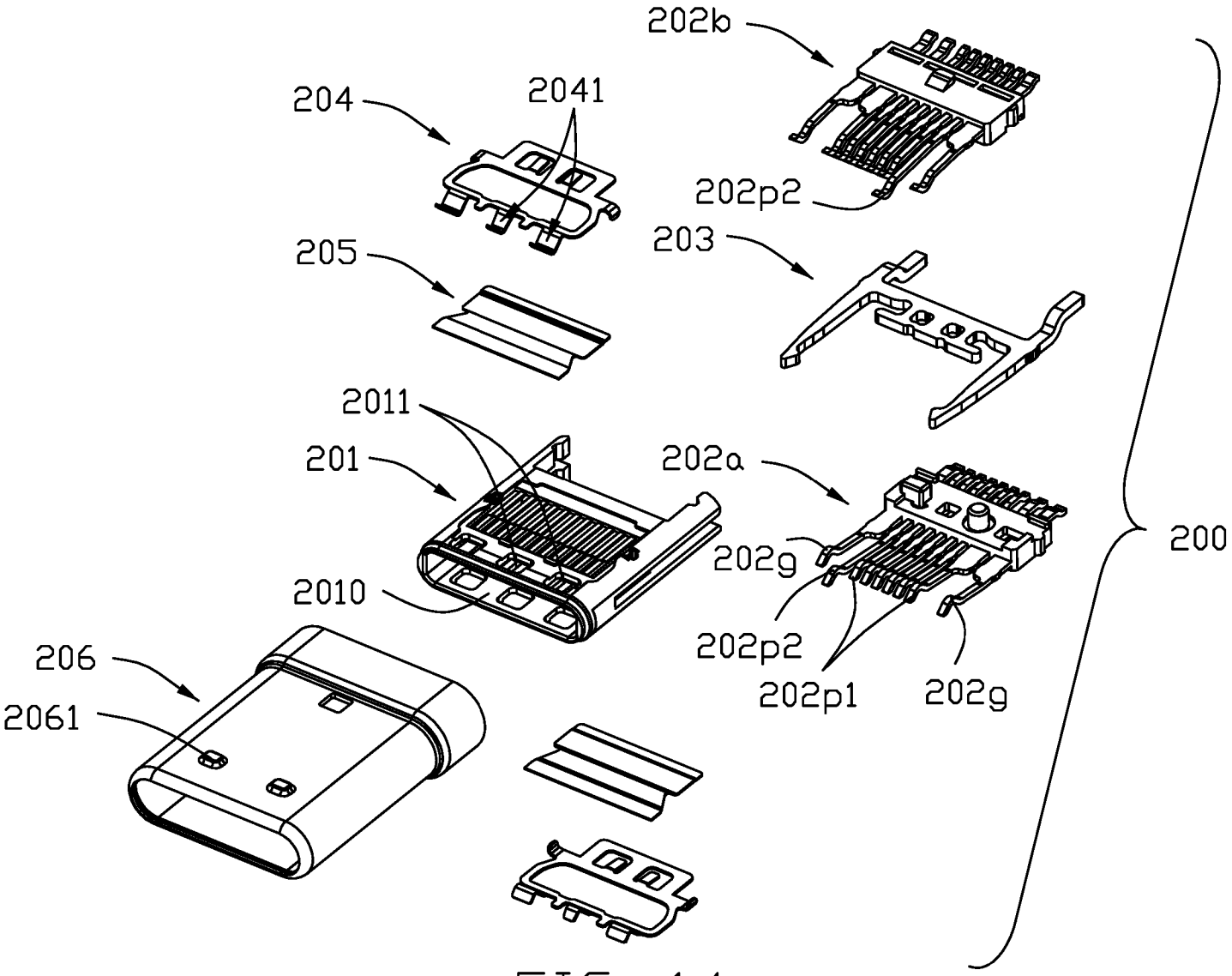
FIG. 14 is a perspective view of a complementary electrical connector in accordance with the present invention.
Figure 15:
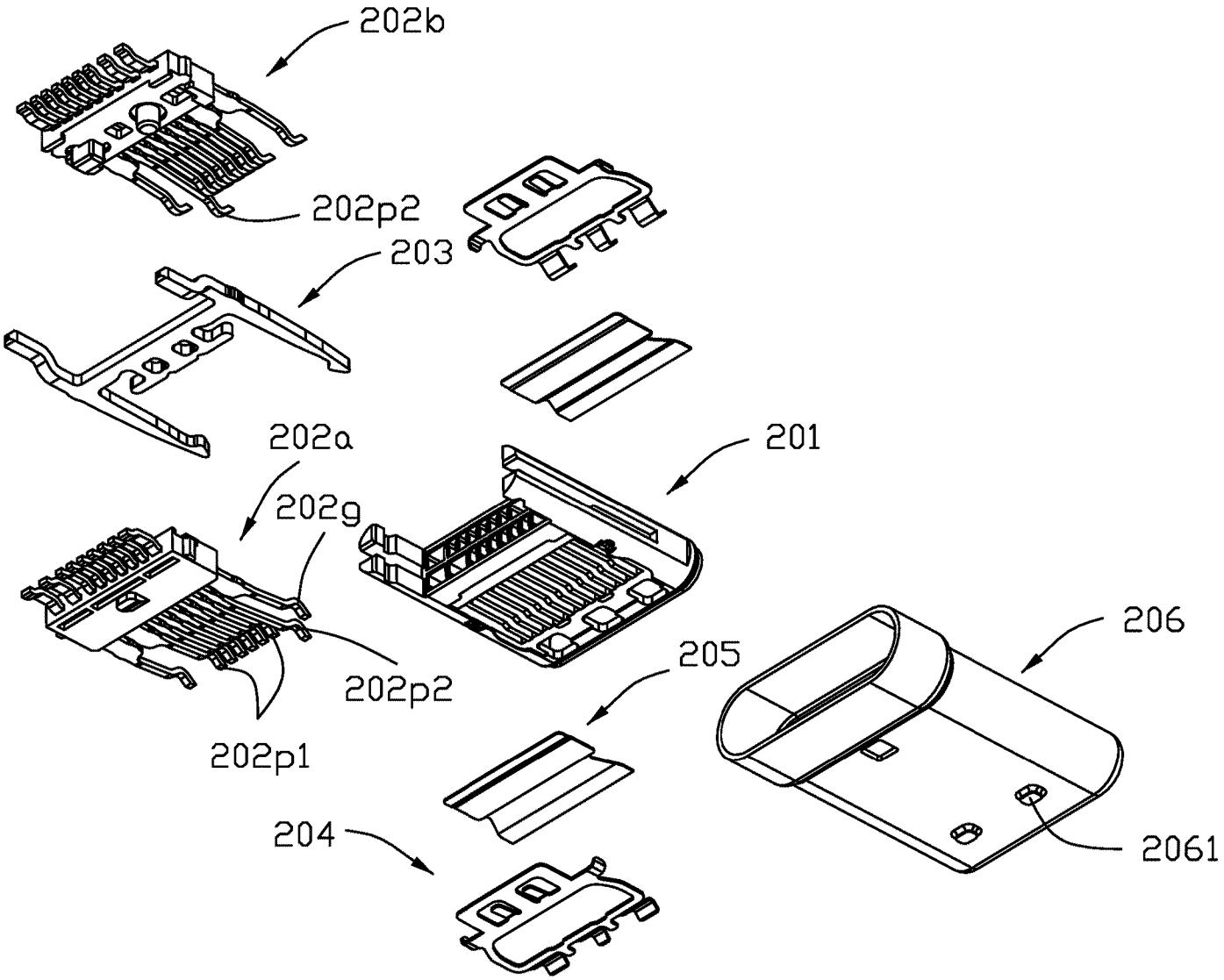
FIG. 15 is a view similar to FIG. 14 but from a different perspective.

Referring to FIGS. 14-15, the shielding cover 206 has corresponding protrusions 2061 adapted for entering the slots 44 of the shielding shell 4. The specific complementary connector 200 having the protrusions 2061 on its shielding cover 206 will not mate an ordinary electrical connector not having slots on its shielding shell, thereby protecting the latter from being inadvertently damaged. On the other hand, since the second power contact 2*p*2 is shorter than the other contacts in the electrical connector 100, an ordinary connector not having any contact intended to mate with such power contact 2*p*2 will not be able to mate with such electrical connector 100.

What is claimed is:

1. An electrical connector comprising:

an insulative housing having a base and a tongue; and a plurality of contacts arranged in an upper and lower rows and exposed respectively to an upper and lower surfaces of the tongue, wherein the upper and lower rows of contacts include a first and second power contacts in the same row, an exposed portion of the second power contact to the tongue being shorter than an exposed portion of the first power contact to the tongue so as to prevent the second power contact from making an electrical contact with an ordinary connector.

2. The electrical connector as claimed in claim 1, wherein the tongue of the insulative housing includes a thickened portion having a groove further exposing the second power contact.

3. The electrical connector as claimed in claim 1, wherein the plurality of contacts include an outermost ground contact, the second power contact being disposed between the outermost ground contact and the first power contact.

4. The electrical connector as claimed in claim 1, further comprising a shielding shell enclosing the insulative housing.

5. An electrical connector assembly comprising:

a first electrical connector including:

an insulative housing having a base and a tongue; and a plurality of contacts arranged in an upper and lower rows and exposed respectively to an upper and lower surfaces of the tongue, the upper and lower rows of contacts including a first and second power contacts in the same row, the second power contact being shorter than the first power contact; and a second electrical connector including a contact module, the contact module including a plurality of contacts arranged in an upper and lower rows and having a first and second power contacts in the same row, the second power contact of the second electrical connector being longer than the first power contact of the second electrical connector and adapted for mating the second power contact of the first electrical connector.

6. The electrical connector assembly as claimed in claim 5, wherein the tongue of the insulative housing includes a thickened portion having a groove further exposing the second power contact of the first electrical connector.

7. The electrical connector assembly as claimed in claim 5, wherein:

the first electrical connector comprises a shielding shell enclosing the insulative housing, the shielding shell having a slot opening to a front thereof; and the second electrical connector comprises a shielding cover enclosing the contact module, the shielding cover having a protrusion adapted for entering the slot of the shielding shell.

8. An electrical cable connector for use with a receptacle connector having a contact module with a plurality of stationary contacts with a shortened power contact exposed around a root region of a tongue portion of the housing while others being exposed upon the full tongue portion, said cable connector comprising:

an insulative housing defining a receiving space for receiving said tongue of the receptacle connector;

two rows of deflectable contacts retained in the housing, commonly extending from a rear portion of the housing and located by two sides of the receiving space;

a metallic shield covering said housing; and a cable extending rearwardly behind the housing and electrically connected to the electrical deflectable contacts;

in each row, all the contacts except one lengthened power contact have corresponding contacting regions relatively far away from a front opening of the receiving space so as to contact the stationary contacts of the receptacle connector at a position around a middle region of the tongue portion while said lengthened power contact having a corresponding contacting region closer to the front opening of the receiving space in a front-to-back direction so as to contact the shortened power contact of the receptacle connector.

9. The electrical cable connector as claimed in claim 8, wherein the shield forms at least one outward protrusion for received within a slot formed in the receptacle connector while failing to other standard receptacle connectors having no slots thereof.

10. The electrical cable connector assembly as claimed in claim 8, wherein the housing forms a plurality of openings around a front opening of the receiving space in front of all contacts in the front-to-back direction except the lengthened power contact in each row.

11. The electrical cable connector as claimed in claim 10, wherein at least one grounding engaging piece attached to the housing and equipped with a plurality of spring fingers extending through the corresponding openings into the receiving space.

12. The electrical cable connector as claimed in claim 11, wherein a contacting region of each spring finger is located in front of that of the lengthened power contact and closer to the front opening of the receiving space than that of the lengthened power contact in the front-to-back direction.

* * * * *